US005481618A

United States Patent [19]

Ross et al.

[11] Patent Number: 5,481,618

[45] Date of Patent: Jan. 2, 1996

[54] INTERCONNECTION OF A SPEAKER USING MAGNETIC COUPLING

[75] Inventors: Danny E. Ross, Plantation; David E. Reiff, Ft. Lauderdale; John F. Murray, Sunrise, all of Fla.

[73] Assignee: Motorola, Inc., Schaumburg, Ill.

[21] Appl. No.: 346,312

[22] Filed: Nov. 28, 1994

Related U.S. Application Data

[63] Continuation of Ser. No. 99,797, Jul. 30, 1993, abandoned.

[51] Int. Cl.[6] ..... H04R 25/00

[52] U.S. Cl. ..... 381/205; 381/188; 381/192

[58] Field of Search ..... 381/205, 188, 381/199, 194, 192; 361/807, 809, 810, 814; 248/206.5, 467, 684, 537; 439/38, 39, 40

[56] References Cited

U.S. PATENT DOCUMENTS 4,312,118 1/1982 Saik et al. ..... 381/199
4,391,532 7/1983 Hara ..... 381/199
4,875,654 10/1989 Chandonnet et al. ..... 248/206.5
5,239,589 8/1993 Yang et al. ..... 381/203

FOREIGN PATENT DOCUMENTS 0001297 1/1988 Japan ..... 381/194

*Primary Examiner*—Curtis Kuntz
*Assistant Examiner*—Sinh Tran
*Attorney, Agent, or Firm*—Dale W. Dorinski; Pedro P. Hernandez

[57] ABSTRACT

A speaker assembly (100) includes a speaker (202) having at least one speaker terminal (206) and a magnet (204) which generates a magnetic field. The speaker assembly (100) also includes a circuit board (116) having at least one terminal (110). A metal member (106) is coupled to the circuit board (116) and is used to magnetically attach speaker (202) to circuit board (116). Upon speaker (202) being magnetically coupled to circuit board (116), the at least one speaker contact (206) becomes coupled to speaker terminal (110). Thereby, allowing for a quick way of attaching and detaching speaker (202) to and from circuit board (116).

18 Claims, 3 Drawing Sheets

INTERCONNECTION OF A SPEAKER USING MAGNETIC COUPLING

This is a continuation of application Ser. No. 08/099,797, filed on Jul. 30, 1993 and now abandoned.

TECHNICAL FIELD

This invention relates in general to speaker assemblies, and more specifically to a speaker assembly which uses the magnetic field generated by a speaker to retain the speaker to the assembly.

BACKGROUND

Communication devices such as two-way FM radios usually comprise a radio housing, an internal speaker, and one or more electrical circuit boards located inside of the radio housing. The internal speaker is typically mechanically attached to the radio housing or to one of the circuit boards inside of the housing, using mechanical fasteners such as screws, rivets, etc. The radio's circuit board(s) are then electrically interconnected to the speaker using electrical connectors which connect to the speaker terminals. Typically, this is done by soldering wires from the speaker terminals to appropriate locations in the circuit boards.

One of the problems presented with an assembly approach as mentioned above is that the circuit boards, especially the audio sections of the circuit boards, can not be fully acoustically tested until the circuit boards are mounted onto the radio housing and the circuit boards are interconnected to the speaker. In the case where either the speaker or the audio circuits are determined not to be fully functional after the radio has been assembled, the radio has to be disassembled in order to correct the defect, wasting valuable manufacturing time.

One technique which is presently used to solve the above mentioned problem is to place the radio circuit board into a test assembly which has a built in speaker in order to test the audio circuits in the circuit board, while the speaker is tested separately in another testing process. This however, requires the use of at least two separate test stations adding testing expense and added testing time to the radio assembly. A need thus exists in the art for a speaker assembly which can provide for ease of assembly and disassembly of the speaker, and which can also hold the speaker in place during assembly and testing of the communication device without the use of mechanical fasteners.

SUMMARY

Briefly, according to the invention, a speaker assembly includes a speaker having a magnet which generates a magnetic field, and a substrate having a speaker retainer means. The speaker is magnetically coupled to the speaker retainer means, thereby allowing for the speaker to be quickly attached and detached.

DETAILED DESCRIPTION OF THE PREFERRED EMBODIMENT

Figure 1:
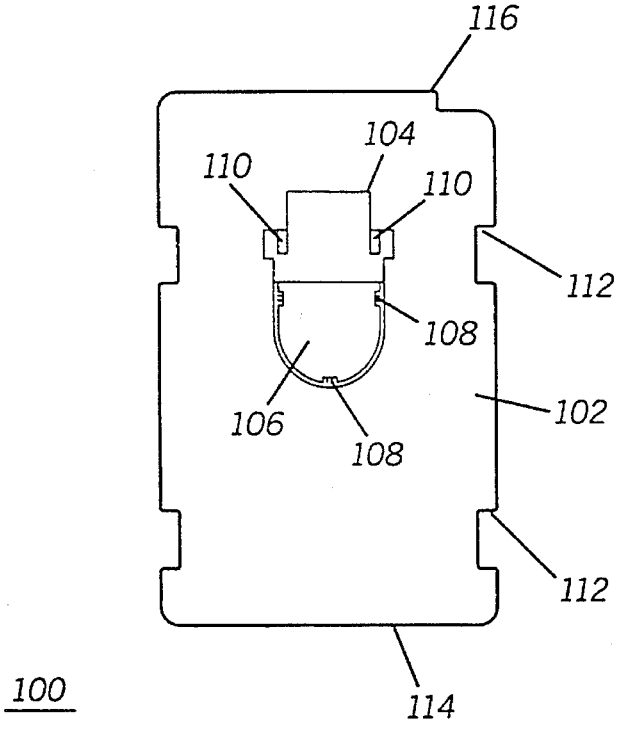
FIG. 1 is a frontal view of a printed circuit board assembly in accordance with the invention is shown.

While the specification concludes with claims defining the features of the invention that are regarded as novel, it is believed that the invention will be better understood from a consideration of the following description in conjunction with the drawing figures, in which like reference numerals are carried forward.

Referring now to FIG. 1, an assembly 100 in accordance with the present invention is shown. Assembly 100 comprises a substrate such as a printed circuit board 116 having first 102 and second 114 opposed surfaces. Circuit board 116 includes a speaker cavity 104 which is used for receiving a speaker (not shown). A speaker retainer means such as a metal member (speaker retainer) 106 having magnetic field attraction capability is attached to the circuit board 116. Speaker retainer 106 can be formed from a number of metals which are attracted to magnetic fields such as steel, ferrous materials, etc. Speaker retainer 106 includes a plurality of resilient finger catches 108 which are used to fasten retainer 106 to the printed circuit board. Finger catches 108 snap-on to the side walls of cavity 104 and hold metal member 106 to circuit board 116. A set of resilient terminals 110 are attached to circuit board 116 and are used to electrically couple the speaker contacts to the circuit board. Located around the perimeter of circuit board 116 are a plurality of notches 112 which are used to engage the circuit board to the radio housing (not shown).

Figure 2:
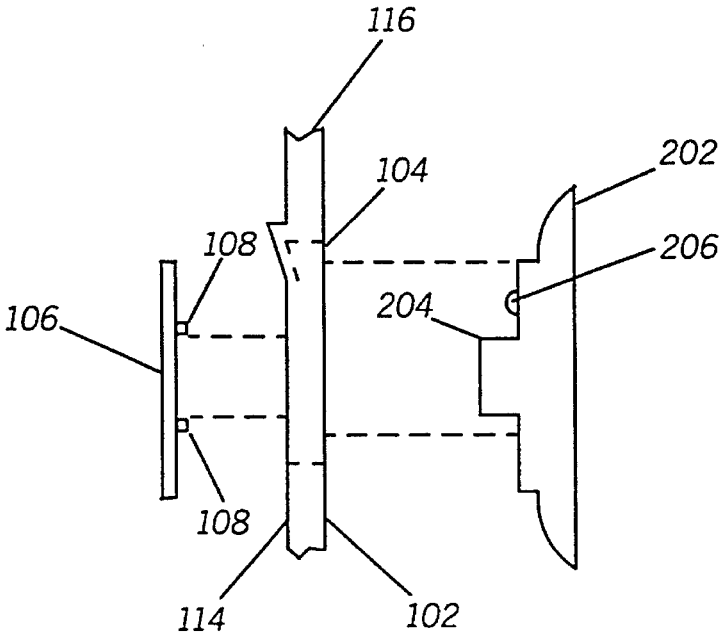
FIG. 2 is an exploded side view of a speaker assembly in accordance with the invention.

In FIG. 2, an exploded side view of the assembly of FIG. 1 is shown, with the addition of a speaker 202. Speaker 202 includes a speaker magnet 204 as is typically found in most speakers. In the preferred embodiment, speaker retainer means 106 is located blocking a portion of cavity 104. Speaker magnet 204 produces a magnetic field having enough strength to cause speaker 202 to become magnetically attached to metal member 106. A pair of speaker contacts 206 mate with the pair of corresponding terminals 110 located on circuit board 116 upon speaker 202 becoming magnetically coupled to speaker retainer 106. Although not shown, a speaker alignment means can be provided in order to properly align speaker 202 to circuit board 116 in order for speaker contacts 206 to properly mate with terminals 110. The speaker alignment means can take the form of spring fingers 108 being long enough to extend past first surface 102 in order to form guide rails for speaker 202. Other types of well known alignment techniques such as guide posts, etc. can also be used. The extension of fingers 108 is preferred in that no extra pieces are required in order to provide for the alignment feature.

Figure 3:
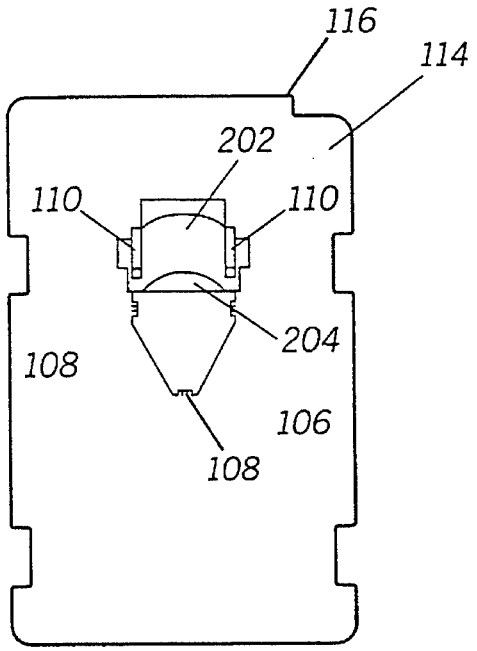
FIG. 3 is the back view of the printed circuit board assembly shown in FIG. 1.

FIG. 3 shows the backside of the assembly shown in FIG. 1. Speaker retainer 106 is shown attached to circuit board 116. The plurality of spring finger catches 108 press against the side walls of cavity 104 in order to attached the speaker retainer 106. Although the present invention uses a plurality of snap-on spring fingers 108 to attach the speaker retainer, other techniques such as the use of screws or adhesives can also be used to attach the speaker retainer. Speaker 202 is shown electrically coupled to printed circuit board 116 via terminals 110. Terminals 110 can be formed from spring metal or other materials which provide a pressure contact to speaker contacts 206. Terminals can be soldered or staked on to circuit board 116.

Figure 4:
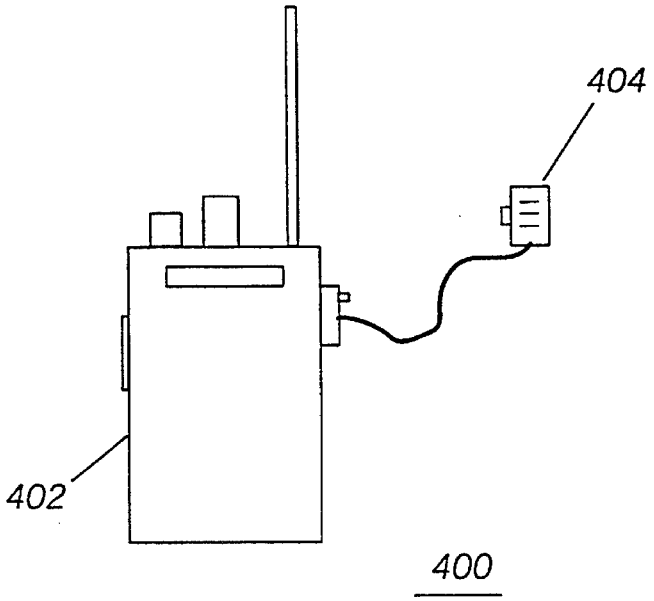
FIG. 4 is an illustration of a communication device in accordance with the present invention.

In FIG. 4, an illustration of a communication device such as a frequency-modulated (FM) two-way radio 402 utilizing the present invention is shown. Other types of communication devices such as pagers, FM/AM broadcast radios, as well as electronic devices which utilize an internal speaker such as consumer electronic devices (e.g., portable cassette players, etc.) can benefit from the present invention. In FIG. 4, a remote speaker/microphone 404 is shown coupled to radio 402. Remote speaker 404 can also include a magnetically coupled speaker in accordance with the invention.

Figure 5:
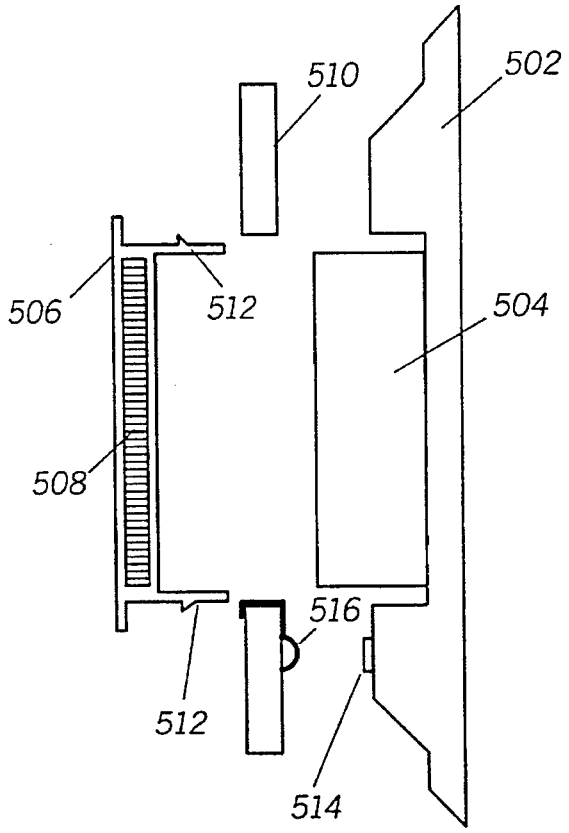
FIG. 5 is an exploded view of another speaker assembly in accordance with the present invention.

Referring now to FIG. 5, an alternate embodiment of the present invention is shown. In this embodiment, instead of using a piece of metal, a plastic member 5 12 having a metal insert 508 is used. Metal insert 508 can be formed from steel or other metals or metal alloys which are attracted to magnetic fields. As the magnetic field produced by speaker magnet 504 gets closer to metal insert 508, the magnetic attraction between magnet 504 and insert 508 provides enough force to magnetically couple speaker 502 to speaker retainer 508. A set of speaker terminals 514 are at the same time electrically coupled to matching contacts 516 located on circuit board 510.

Figure 6:
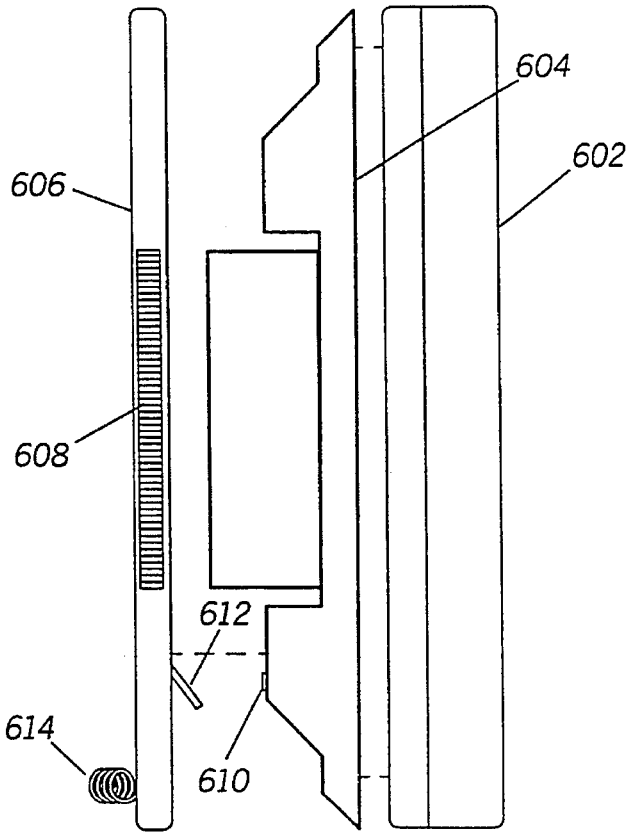
FIG. 6 is an exploded view of a remote speaker assembly in accordance with the present invention.

In FIG. 6 a remote speaker assembly 600 in accordance with the present invention is shown. Speaker assembly is similar to remote speaker assembly 404, shown in FIG. 4. Speaker assembly 600 includes a first housing member 602 which includes a speaker grill portion 610. A speaker 604 is attached to housing 602 using conventional fastening means such as snap-on fasteners, screws, etc. Finally, a back housing member 606 which includes a metallic insert 608 is magnetically coupled to speaker 604. Back housing member 606 does not require any mechanical fasteners, and allows for ease of assembly for the remote speaker assembly. Upon the second housing member becoming magnetically coupled to first housing member 502, at least one speaker contact 610 becomes coupled to at least one speaker terminal 612. Speaker terminal 612 is in turn electrically coupled to speaker cable 614 which electrically couples the speaker to a communication device such as a radio (not shown). Typically, speaker 604 includes two speaker contacts which couple to a set of speaker terminals 610 located on second housing member 606.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

In summary, the present invention provides for a quick way of interconnecting a speaker using the magnetic field produced by the speaker itself in order to couple the speaker to the assembly. The invention allows for a quick way of interconnecting a speaker, and allows for the testing of the speaker and circuit board as one assembly prior to the circuit board being placed into a housing. Once in the housing, the housing walls can provide for extra support to the magnetically coupled speaker by providing adding mechanical bias to the assembly. The radio housing can provide added mechanical bias in the form of a pressure fit forcing the speaker against the circuit board or by the use of other well known mechanical biasing techniques. In case of a malfunction in either of the circuit board, or speaker during initial testing, the speaker can be quickly removed and the problem corrected. Also, by using magnetic coupling, a speaker assembly can be manufactured which requires no mechanical fasteners saving both time and manufacturing costs.

What is claimed is:

1. An electrical interconnecting system for a speaker, comprising:

a speaker having a magnet and an electrical terminal;

a printed circuit board having a contact corresponding to the electrical terminal, and having a magnetically susceptible portion; and the speaker physically and electrically connected to the printed circuit board by means of magnetic attraction between the magnet and the magnetically susceptible portion, to simultaneously mate the contact to the electrical terminal and attach the speaker to the printed circuit board.

2. The electrical interconnecting system for a speaker as described in claim 1, further comprising a second electrical terminal on the speaker and a second contact on the printed circuit board, the second electrical terminal mating to the second contact when the printed circuit board is connected to the speaker.

3. The electrical interconnecting system for a speaker as described in claim 1, wherein the speaker electrical terminal is not soldered to the printed circuit board contact and is easily removable.

4. The electrical interconnecting system for a speaker as described in claim 3, wherein the electrical terminal is resilient.

5. The electrical interconnecting system for a speaker as described in claim 3, wherein the contact is resilient.

6. The electrical interconnecting system for a speaker of claim 5, wherein the magnetically susceptible portion is not a magnet.

7. An electrical device having a removable connection to a speaker, comprising:

an electrical circuit disposed on a circuit carrying substrate, a portion of the circuit carrying substrate being magnetically attractable;

a speaker having a magnet and electrical terminals;

a housing having the electrical circuit disposed on the circuit carrying substrate and the speaker disposed therein, the speaker mounted to the housing;

the circuit carrying substrate electrically and mechanically coupled to the speaker electrical terminals to provide electrical interconnection between the electrical circuit and the speaker, by means of magnetic attraction between the magnet and said portion of the circuit carrying substrate.

8. The electrical device of claim 7, wherein the circuit carrying substrate is removably connected to the speaker.

9. The electrical device of claim 7, wherein at least one of the electrical terminals is resilient.

10. The electrical device of claim 7, wherein the circuit carrying substrate has a resilient portion.

11. The electrical device of claim 7, wherein said portion of the circuit carrying substrate is not a magnet.

12. A radio, comprising:

a housing;

a speaker disposed within the housing and having a speaker terminal and a magnet;

a circuit board having a contact and a magnetically attractable speaker retainer means; and the speaker retainer means mechanically connected to the speaker by magnetic attraction to the magnet, wherein the circuit board is simultaneously attached to the speaker and electrical interconnection is provided between the speaker terminal and the circuit board contact.

13. A radio as defined in claim 12, wherein the speaker retainer means comprises a plastic member having a metallic insert.

14. A radio as defined in claim 13, wherein the circuit board includes a speaker cavity and the metallic insert is coupled to the circuit board as to cover at least a portion of the cavity.

15. A radio as defined in claim 12, wherein the speaker retainer means includes a plurality of resilient fingers which mechanically attach the speaker retainer means to the circuit board.

16. The radio as defined in claim 12, wherein the speaker terminal is resilient.

17. The radio as defined in claim 12, wherein the circuit board contact has a resilient portion.

18. The radio as defined in claim 12, wherein the magnetically attractable speaker retainer means is not a magnet.

* * * * *